US005400448A

United States Patent [19]

Zwickey

[11] Patent Number: 5,400,448

[45] Date of Patent: Mar. 28, 1995

[54] AMBULANCE GURNEY MATTRESS

[76] Inventor: Wayne C. Zwickey, 209 12th Ave. Northeast, Minneapolis, Minn. 55413

[21] Appl. No.: 138,245

[22] Filed: Oct. 15, 1993

[51] Int. Cl.[6] ..... A61G 7/00

[52] U.S. Cl. ..... 5/462; 5/465; 5/470; 5/473; 5/481; 5/625; 5/628; 128/870

[58] Field of Search ..... 5/625, 626, 628, 462, 5/465, 470, 473, 474, 481, 655; 128/869, 870, 876

[56] References Cited

U.S. PATENT DOCUMENTS

| | | | |
|---|---|---|---|
| 1,295,770 | 2/1919 | Lamont | 5/462 |
| 3,146,469 | 9/1964 | Slade | 5/465 |
| 3,419,920 | 1/1969 | Maddux, Jr. et al. | 5/465 X |
| 3,803,646 | 4/1979 | Newerowski | 5/474 X |
| 4,168,554 | 9/1979 | Hindes | 5/465 |
| 4,628,557 | 12/1986 | Murphy | 5/465 X |
| 4,706,313 | 11/1987 | Murphy | 5/473 X |
| 4,757,811 | 6/1988 | Clark | 128/876 |
| 4,819,286 | 4/1989 | Beauchamp | 5/462 X |
| 4,977,630 | 12/1990 | Oswalt et al. | 5/655 X |
| 4,979,520 | 12/1990 | Boone, Jr. et al. | 128/876 X |
| 5,016,620 | 5/1991 | Matthews | 128/870 X |
| 5,101,527 | 4/1992 | Wadsworth, III et al. | 5/470 X |
| 5,107,558 | 4/1992 | Luck | 5/481 X |
| 5,121,756 | 6/1992 | Koledin | 5/629 X |
| 5,154,185 | 10/1992 | Latimer et al. | 128/870 |

FOREIGN PATENT DOCUMENTS

| | | | |
|---|---|---|---|
| 9321871 | 11/1993 | WIPO | 128/869 |

*Primary Examiner*—Michael F. Trettel

*Attorney, Agent, or Firm*—Nawrocki, Rooney & Sivertson

[57] ABSTRACT

A gurney mattress configured for an adult patient including an elongated cover enclosing a first compartment having a top, bottom and oppositely disposed sides. The compartment is configured to contain a non-adult patient. The top of the compartment is hingably attached with respect to the remainder of the cover allowing the compartment to be alternately opened and closed. Padded bumpers are disposed proximate the compartment sides. A cushion is attached to the top so that, when the compartment is closed, the cushion is received within the compartment generally between the padded bumpers. When the compartment is opened, the cushion is removed from the compartment.

18 Claims, 4 Drawing Sheets

AMBULANCE GURNEY MATTRESS

FIELD OF THE INVENTION

The present invention pertains generally to ambulance gurneys, and in particular to an improved mattress for an ambulance gurney.

BACKGROUND OF THE INVENTION

Ambulance gurneys have long been used for transporting injured or incapacitated people. Typical ambulance gurneys generally include a mattress resting atop and/or fastened to a supporting surface. The supporting surface is generally mounted atop a wheeled, adjustable frame. The wheels allow the gurney to be pushed or pulled along the ground. The height of the mattress relative to the ground can be varied by adjusting the frame.

Prior to applicant's invention, the length and width of most gurney mattresses were configured to accommodate an adult patient. Harnesses attached to the gurney extended width-wise across the mattress to retain the patient on the mattress. Like the mattress, the harness was sized to accommodate adult patients.

SUMMARY OF THE INVENTION

The present invention pertains to an improved gurney mattress, sized to accommodate both adult and non-adult patients. Applicant's invention provides a mattress to secure both adult and non-adult patients.

The gurney mattress of the present invention may include a cushion having a bottom surface configured to be placed on a gurney and a top surface configured to support an adult. There may be a compartment within the cushion having a bottom and sides configured to contain a non-adult patient.

The cushion can include a foam pad surrounded by a cover. The cover can have an opening into the compartment within the cushion. The cover can include a zipper for alternately opening and closing the opening.

The mattress can include a cardiopulmonary resuscitation (CPR) board disposed proximate the top surface of the cushion between the cover and the foam padding. If the gurney mattress includes a CPR board, a heart symbol may be disposed on the top surface to indicate the existence and location of the CPR board.

The compartment may include a harness configured to surround and retain a non-adult patient within the compartment. The compartment may also be configured to receive a backboard for a non-adult patient.

In one of the embodiments of the gurney mattress, an elongated cover defines a first compartment having a top, bottom, and oppositely disposed sides. The compartment is configured to contain a non-adult patient. The top can be hingably attached with respect to the remainder of the cover allowing the compartment to be alternately opened and closed. Padded bumpers may be disposed within the compartment adjacent the sides.

A cushion can be attached to the top so that when the compartment is closed, the cushion is disposed within the compartment and between the padded bumpers. When the compartment is opened, the cushion is removed from the compartment.

The elongated covering may define a second compartment having a top, bottom and oppositely disposed sides. The second compartment is also configured to contain a non-adult patient. The second compartment may be configured to contain a smaller non-adult patient than the first compartment.

Like the first compartment, the second compartment may include padded bumpers disposed adjacent the sides, and a cushion attached to the top of the second compartment. The top of the second compartment can be hingably attached relative to the remainder of the cover allowing the second compartment to be alternately opened and closed so that when the second compartment is closed, the cushion is disposed within the second compartment generally between the padded bumpers. When the compartment is opened the cushion is removed from the compartment. Both the first and second compartments may contain a harness configured to retain a non-adult patient within each respective compartment.

The padded bumpers may be surrounded by a fluid-resistant covering, and attached by hook and loop fastener to the cover. A head immobilization device, also at least partially covered by a fluid-resistant covering, may be operably connected to the cover by hook and loop fastener. A skinned foam pad may be disposed on the bottom of the compartment.

In another embodiment of the gurney mattress configure for an adult patient an elongated foam pad may be surrounded by a cover. A three point harness may be operable connected to the foam pad and configured to retain a non-adult patient on the mattress.

DETAILED DESCRIPTION OF THE INVENTION

Figure 1:
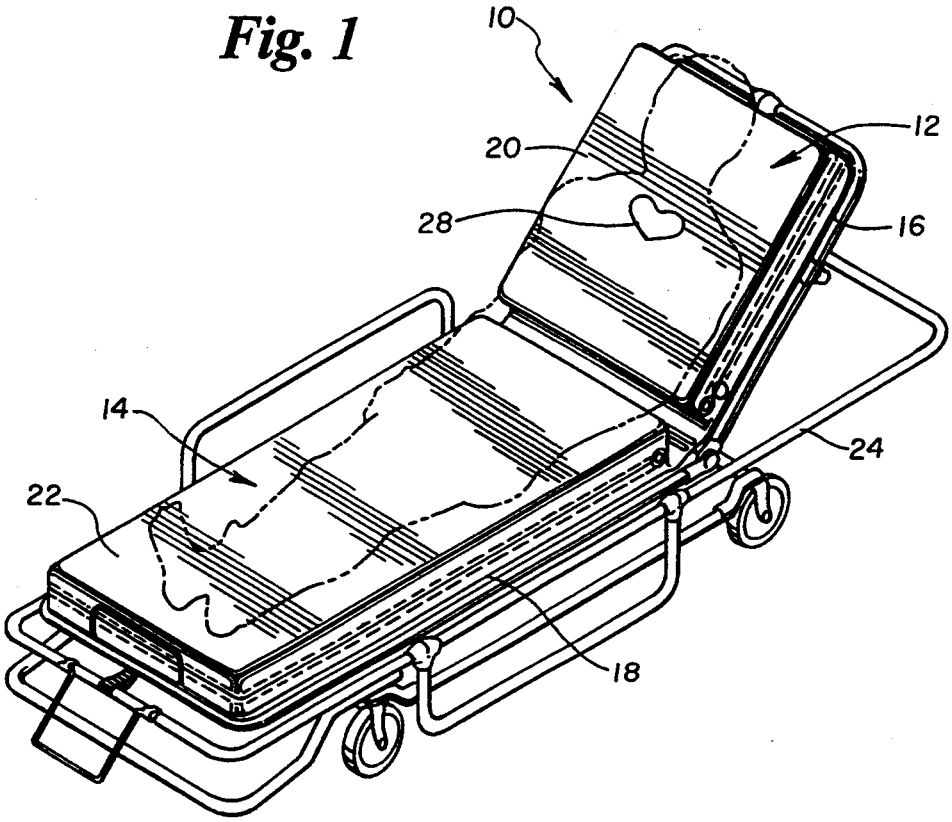
FIG. 1 is a perspective view of a gurney mattress in accordance with present invention.

Referring now to the drawings wherein like reference numerals indicate like elements throughout the several views, FIG. 1 shows a gurney mattress 10 in accordance with the present invention. Gurney mattress 10 may include one or more cushions, for example cushions 12 and 14. Cushions 12 and 14 have bottom surfaces 16 and 18 and top surfaces 20 and 22, respectively. The bottom surface or surfaces 16 and 18 are configured to be placed on a gurney, such as gurney 24. The top surface or surfaces 20 and 22 are configured to support an adult patient as shown by broken line in FIG. 1.

Figure 2:
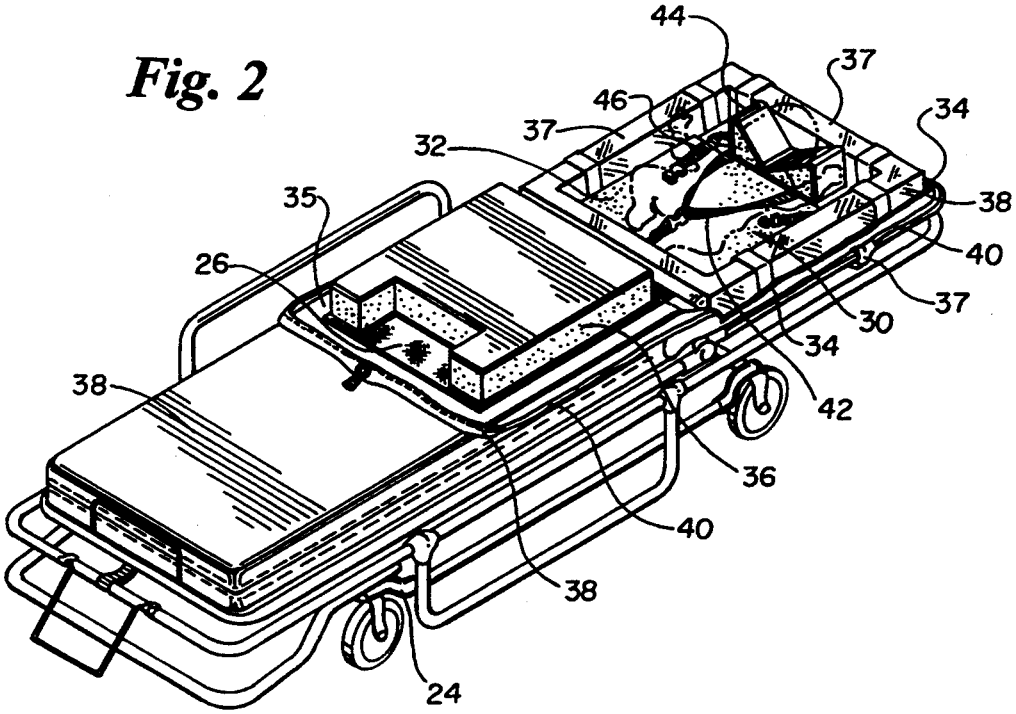
FIG. 2 is a perspective view of a gurney mattress in accordance with the present invention having an open compartment for a non-adult patient.

The gurney mattress may include a cardiopulmonary resuscitation (CPR) board 26 (as shown in FIG. 2). If the mattress includes a CPR board, a heart symbol 28 may be placed on the top surface 20 of cushion 12 to indicate the presence and location of CPR board 26.

As shown in FIG. 2, an elongated cover 38 may define a compartment 30 formed in cushion 12. Compartment 30 includes a bottom 32 and sides 34 configured to contain a non-adult patient. As used herein non-adult refers generally to the patient's size rather than chronological age. The size of the non-adult patient would be significantly less than the size of an adult patient. An adult patient lying on the mattress 10 would extend over substantially the entire length of gurney mattress 10, whereas a non-adult patient would extend over substantially less than the entire length. A non-adult patient would likely, but not necessarily, be a pre-adolescent patient.

Cover 38 includes an opening into compartment 30 within cushion 12. As shown in FIG. 2, compartment 30 may include a top 35 hingably attached to the remainder of cover 38. Top 35 is hingably attached to alternately open and close the opening. Cover 38 may also include a zipper around the opening.

Padded bumpers 37 may be disposed proximate compartment 30 adjacent sides 34. A filler pad 36 may be attached to top 35 so that, when compartment 30 is closed, pad 36 is received within compartment 30 between padded bumpers 37. When compartment 30 is opened, pad 36 is removed from compartment 30.

Compartment 30 may also include a harness 42 for retaining the non-adult patient in compartment 30. Harness 42 is preferably a 3 point harness having one strap configured to extend over each shoulder and a third between the legs of the non-adult patient.

A head immobilization device 44 may be fastened within compartment 30. In a preferred embodiment, the neck brace is similar to a device disclosed in U.S. Pat. No. 5,146,641 to Zwickey. A strap 46 operably connected to cover 38 may be provided to retain the patient's head in device 44.

Figure 3:
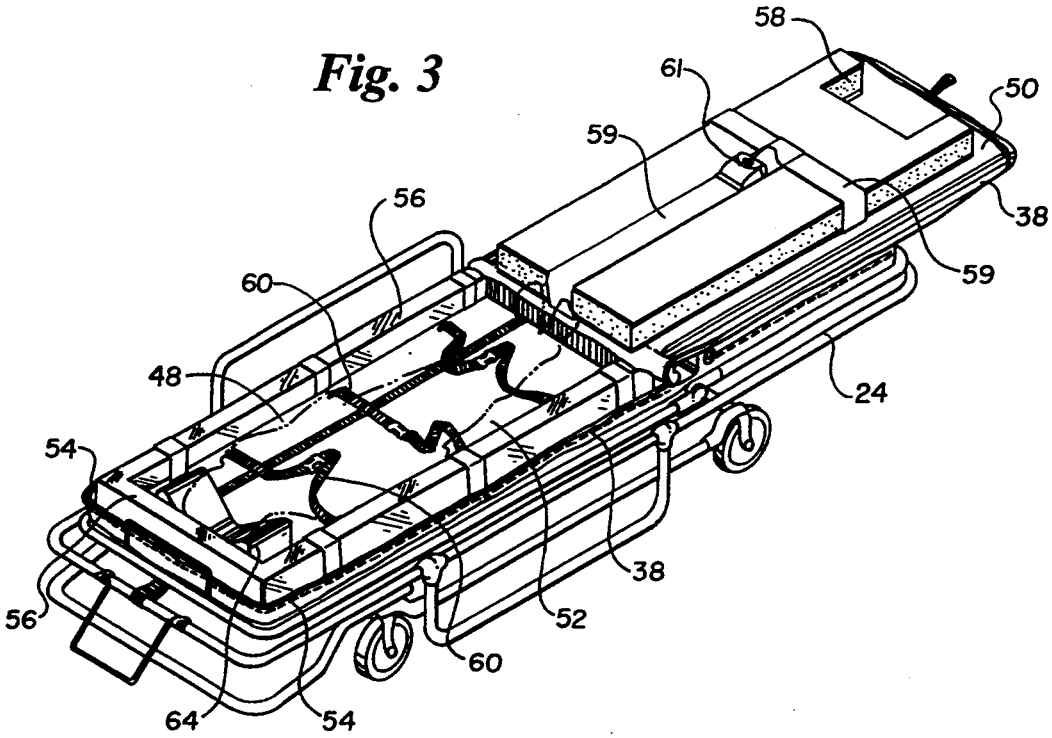
FIG. 3 is a perspective view of the gurney mattress in accordance with the present invention having a compartment opened for a larger non-adult patient.

As shown in FIG. 3, the elongated covering 38 may define a second compartment 48. Compartment 48 may include a top 50, bottom 52 and sides 54. Like compartment 30, second compartment 48 is configured to contain a non-adult patient. In one embodiment, second compartment 48 may be configured to contain a non-adult patient larger than the non-adult patient compartment 38 is configured to contain.

Padded bumper 56 may be placed within second compartment 48. A cushion 58 may be attached to top 50 of second compartment 48 by straps 59. A convenient tool pouch 61 may be attached to strap 59. Top 50 of compartment 48 may be hingably attached relative to the remainder of cover 38 allowing second compartment 48 to be alternatively opened and closed. When second compartment 48 is closed, cushion 58 is disposed within compartment 48 generally within the confines of padded bumper 56. When compartment 48 is opened, as shown in FIG. 3, cushion 58 is removed from compartment 48.

Figure 4:
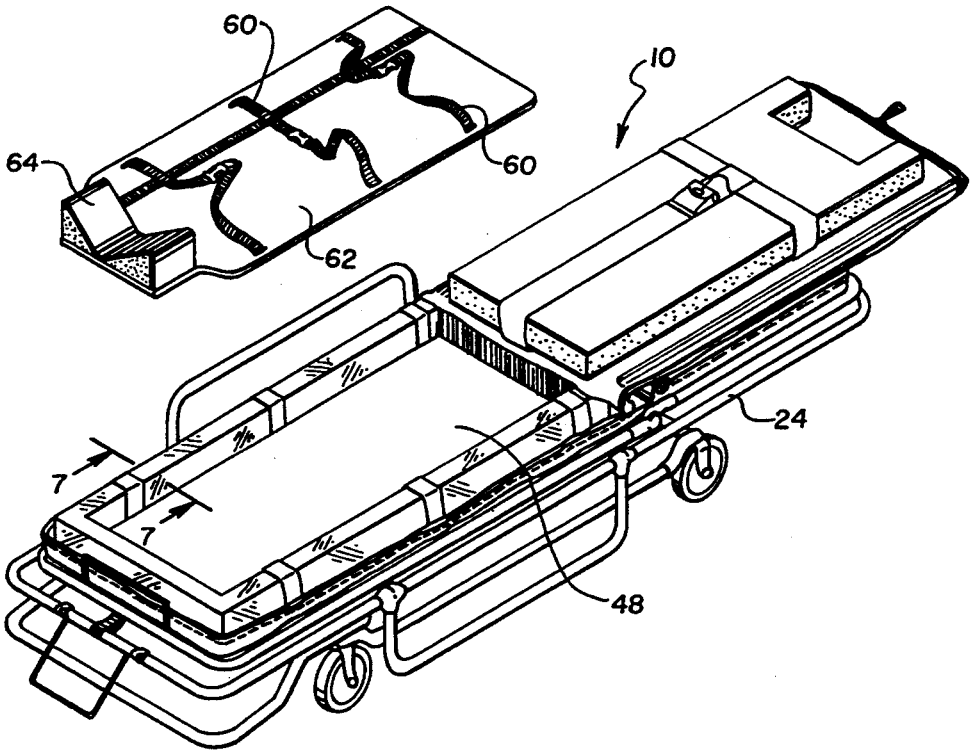
FIG. 4 is a perspective view of a gurney mattress in accordance with the present invention showing an optional backboard.

A harness 60 may be included in compartment 48. In one embodiment, as shown in FIG. 4, harness 60 is fastened to a backboard 62 which may be placed in compartment 48. Backboard 62 may also include an operably connected head immobilization device 64 similar to head immobilization device 44.

Figure 5:
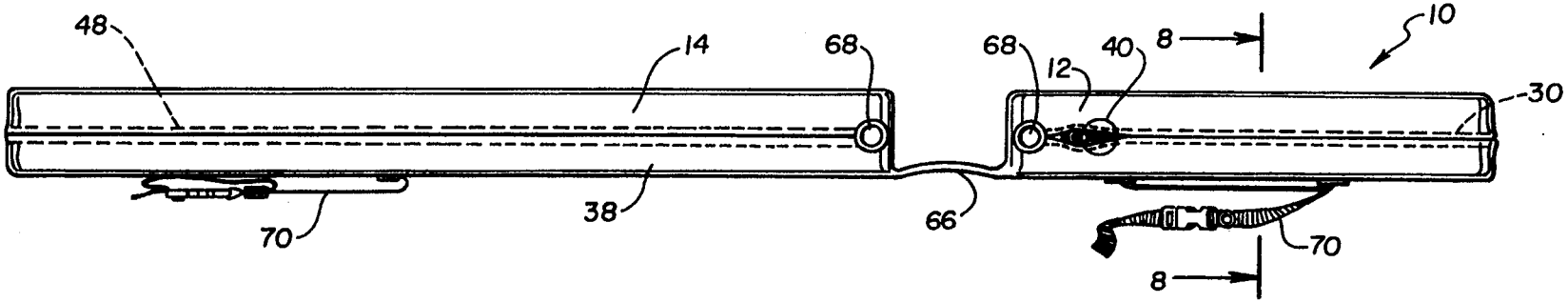
FIG. 5 is a side view of the gurney mattress in accordance with the present invention.
Figure 6:
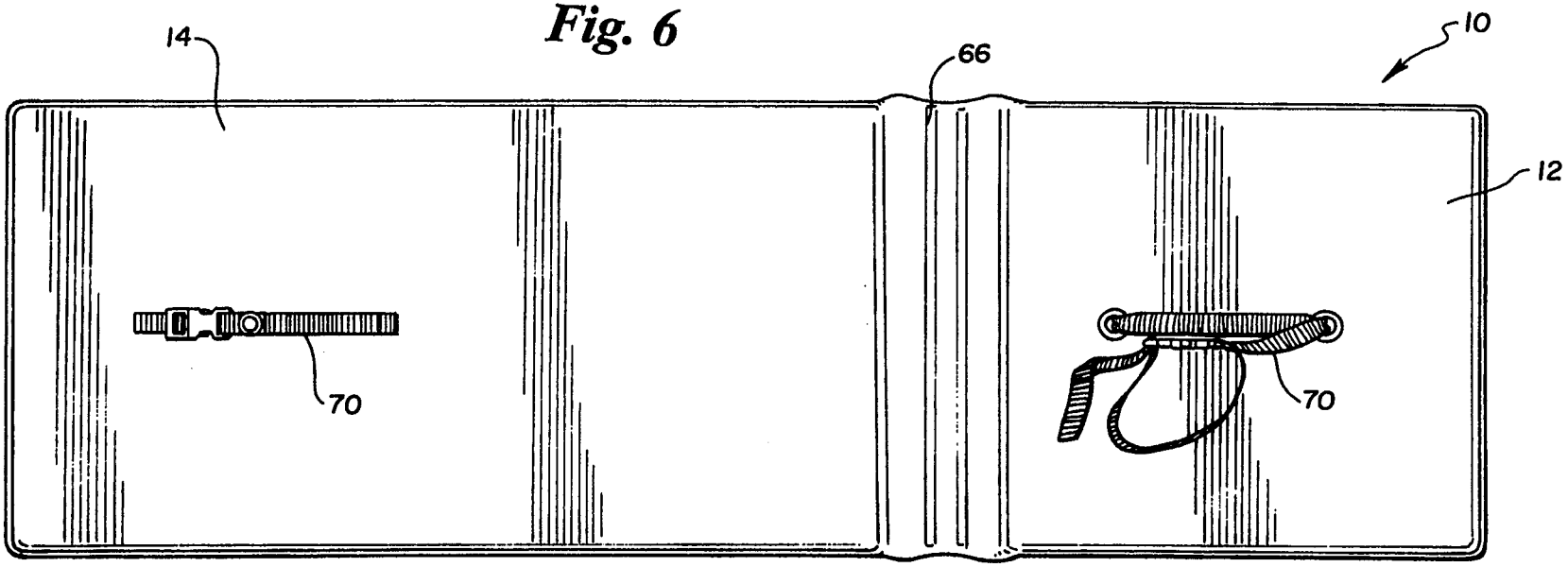
FIG. 6 is a bottom view of the gurney mattress in accordance with the present invention.

FIGS. 5 and 6 show top and bottom views of gurney mattress 10 respectively. As shown in FIG. 5, gurney mattress 10 includes two cushions 12 and 14 each defined by elongated cover 38. Marine grade vinyl may be used to make cover 38. Cushions 12 and 14 may be separated by a space, bridged by a web 66. Compartments 30 and 48 can be held closed by zippers 40. A vent hole 68 may extend into each compartment 30 and 48. Straps 70 can be provided to attach mattress 10 to gurney 24.

The materials used to construct mattress 10 have been selected, in part, in an effort to meet certain regulations of the Occupational Safety and Health Administration (OSHA).

Figure 7:
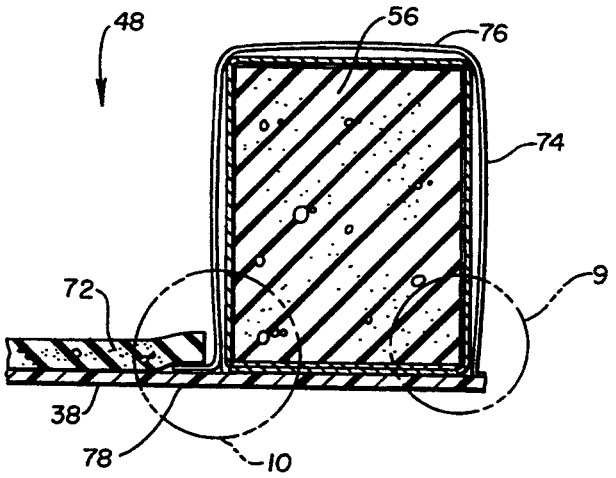
FIG. 7 is a partial cross-section of the gurney mattress in accordance with the present invention taken generally along line 7—7 of FIG. 4.
Figure 8:
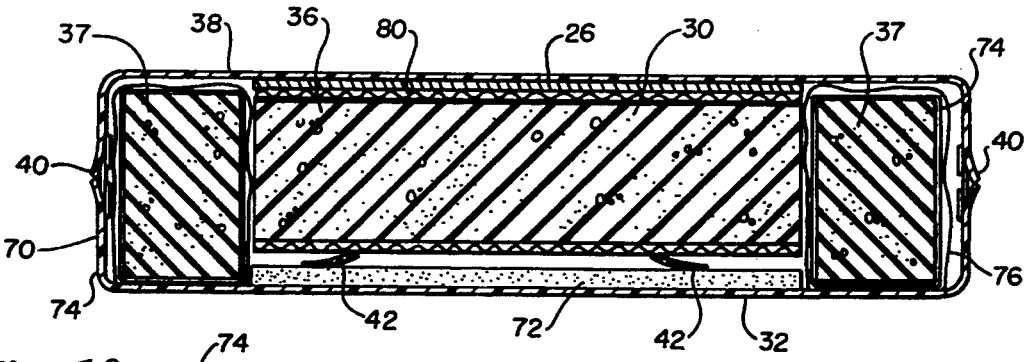
FIG. 8 is a cross-section of the gurney mattress in accordance with the present invention taken generally along line 8—8 of FIG. 5.
Figure 9:
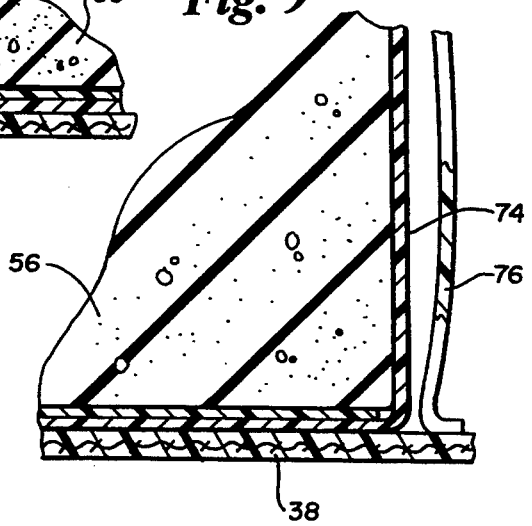
FIG. 9 is a partial cross-section of the gurney mattress in accordance with the present invention showing structure within the circle 9 in FIG. 7.

FIGS. 7–9 show various cross sections of mattress 10. FIG. 7 is a cross section taken from FIG. 4 extended partially through compartment 48. A skinned foam pad 72 may be fastened to bottom 52 of second compartment 48 by hook and loop fastener. Padded bumper 56 may be surrounded by a fluid-resistant plastic sheet 74 and held within compartment 48 by straps 76 operably connected to cover 38 and including a hook and loop fastener 78.

FIG. 8 shows a cross section taken through compartment 30 from FIG. 5. The cross section includes cover 38 held in the closed position by zipper 40. A skinned foam pad 72 may be fastened to bottom 32 of compartment 30 by hook and loop fastener means.

Harness 42 is shown in cross section. Bumpers 37 are wrapped in a plastic sheet 74 and retained in compartment 30 by straps 76 having hook and loop fastener means 78. Fiber boards 80 may be attached to opposite sides of foam pad 36. CPR board 26 is shown disposed between cover 38 and one of the fiber boards 80.

FIG. 9 is an enlarged view of a portion of FIG. 7 showing a portion of bumper 56 surrounded by plastic sheet 74. Bumper 56 is fastened to covering 38 by strap 76.

Figure 10:
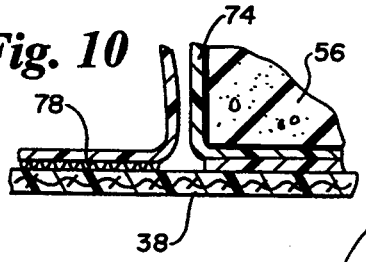
FIG. 10 is a partial cross-section of the gurney mattress in accordance with the present invention showing structure within the circle 10 in FIG. 7.

FIG. 10 is a partial cross-section of mattress 10 taken from FIG. 7 showing hook and loop fastener 78 of strap 76° A similar fastener may be used on all straps 76 for both compartments 30 and 48.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. In a gurney mattress having a cushion having a bottom surface configured to be placed on a gurney and a top surface configured to support an adult patient, wherein the improvement comprises:

a compartment defined within the cushion, the compartment including a bottom and sides configured to contain a non-adult patient, the compartment including a harness configured to surround and retain a non-adult patient within the compartment.

2. A gurney mattress, in accordance with claim 1, wherein the cushion includes a foam pad surrounded by a cover.

3. A gurney mattress, in accordance with claim 2, wherein the cover includes an opening into the compartment defined within the cushion.

4. A gurney mattress, in accordance with claim 3, wherein the cover includes a zipper for alternately opening and closing the opening.

5. A gurney mattress, in accordance with claim 2, the mattress further comprising a cardiopulmonary resuscitation board disposed proximate the top surface between the cover and the foam padding.

6. A gurney mattress, in accordance with claim 5, further comprising indicia disposed on the top surface to indicate that the mattress includes the cardiopulmonary resuscitation board.

7. A gurney mattress, in accordance with claim 1, wherein the compartment is configured to receive a backboard.

8. A gurney mattress configured for an adult patient, comprising:

an elongated cover defining a first compartment having a top, bottom and oppositely disposed sides, the first compartment being configured to receive a non-adult patient, and the top being hingably attached to define said top and a remainder portion of the cover allowing the compartment to be alternately opened and closed;

padded bumpers disposed along the compartment sides; and a pad attached to the top so that, when the compartment is closed, the pad is received within the compartment between the padded bumpers, and, when the compartment is opened, the pad is removed from the compartment.

9. A gurney mattress, in accordance with claim 8, wherein the elongated covering defines a second compartment having a top, bottom and sides, the second compartment configured to receive a non-adult patient.

10. A gurney mattress, in accordance with claim 9, wherein the second compartment is configured to receive a non-adult patient larger than the non-adult patient the first compartment is configured to receive.

11. A gurney mattress, in accordance with claim 9, the gurney mattress further comprising padded bumpers along sides of the second compartment, and a cushion attached to the top of the second compartment; wherein the top of the second compartment is hingably attached relative to the remainder of the cover allowing the second compartment to be alternately opened and closed so that, when the second compartment is closed, the cushion is disposed within the compartment generally between the padded bumpers, and, when the compartment is opened, the cushion is removed from the compartment.

12. A gurney mattress, in accordance with claim 9, wherein each compartment contains a harness configured to retain a non-adult patient within each respective compartment.

13. A gurney mattress, in accordance with claim 8, wherein the padded bumpers are surrounded by a fluid-resistant covering, and attached by hook and loop fastener to the cover.

14. A gurney mattress, in accordance with claim 8, further comprising a head immobilization device within the compartment.

15. A gurney mattress, in accordance with claim 8, further comprising a skinned foam pad disposed on the bottom of the compartment.

16. A gurney mattress, in accordance with claim 8, further comprising a cardiopulmonary resuscitation (CPR) board disposed adjacent and operably connected to the top of the compartment.

17. A gurney mattress, in accordance with claim 16, further comprising a heart symbol disposed on an outside surface of the cover adjacent the CPR board, to indicate the location and presence of the CPR board.

18. In a gurney mattress having a cushion having a bottom surface configured to be placed on a gurney and a top surface configured to support an adult patient, wherein the improvement comprises:

a compartment defined within the cushion, the compartment including a bottom and sides configured to contain a non-adult patient, wherein the cushion includes a foam pad surrounded by a cover; and a cardiopulmonary resuscitation board disposed proximate the top surface between the cover and the foam pad.

* * * * *